US006281854B1

(12) United States Patent
Ohoka et al.

(10) Patent No.: US 6,281,854 B1
(45) Date of Patent: Aug. 28, 2001

(54) ANTENNA FOR PORTABLE RADIO DEVICE

(75) Inventors: Shinji Ohoka, Nishio; Noboru Maeda, Chiryu; Masao Hasegawa, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/579,507

(22) Filed: May 26, 2000

(30) Foreign Application Priority Data

May 28, 1999 (JP) ..... 11-150447
Apr. 13, 2000 (JP) ..... 12-112436

(51) Int. Cl.[7] ..... H01Q 1/12

(52) U.S. Cl. ..... 343/767; 343/718

(58) Field of Search ..... 343/767, 746, 343/713, 702, 718

(56) References Cited

U.S. PATENT DOCUMENTS

| | | | | |
|---|---|---|---|---|
| 3,825,833 | * | 7/1974 | Bogue | 325/119 |
| 5,589,840 | * | 12/1996 | Fujisawa | 343/718 |
| 5,677,698 | * | 10/1997 | Snowdon | 343/770 |
| 5,754,143 | * | 5/1998 | Warnagiris et al. | 343/767 |

FOREIGN PATENT DOCUMENTS

| | | |
|---|---|---|
| 5-288869 | 11/1993 | (JP) . |
| 7-231217 | 8/1995 | (JP) . |
| 8-32331 | 2/1996 | (JP) . |
| 8-80288 | 3/1996 | (JP) |

OTHER PUBLICATIONS

Ito et al., Analysis and Design of Antenna for Mobile Communication Device, Chapter 2, §5.2 (1995, Trikepps).

Fujisawa et al., A Study on Small Slot Antenna for Wrist Watch Type Portable Radio Equipment, Abstract, p. 37 (1993, Institute of Electronics, Information and Communication Engineers).

Kuboyama et al., Slot Dipole Antenna, pp. 1–81 (1984, Institute of Applied Physics, University of Tsukuba).

* cited by examiner

*Primary Examiner*—Don Wong
*Assistant Examiner*—James Clinger
(74) *Attorney, Agent, or Firm*—David G. Posz; Law Office of David G. Posz

(57) ABSTRACT

A finger-ring-type radio device is worn by a person to wirelessly transmit his physical data such as blood pressure or pulsation. The radio device is composed of a finger ring having a slot antenna as a magnetic-field-mode antenna and a flat plate having a patterned antenna as an electric-field-mode antenna. A transmission circuit for generating high frequency signals representing the physical data is also mounted on the flat plate. Both antennas having respective characteristics and radiation directivities are combined to form a composite antenna from which the high frequency signals are radiated. The radiation efficiency of the composite antenna is improved by combining both antennas. The slot length of the slot antenna is extended by forming it in a zigzag shape, so that the slot length properly corresponds to the high frequency to be radiated and the antenna efficiency is improved. A ground surface of the transmission circuit mounted on the flat plate may be utilized as the electric-field-mode antenna in place of the patterned antenna by coupling the ground surface with an electric-field-mode component included in the slot antenna.

18 Claims, 13 Drawing Sheets

EQUIVALENT SLOT ANTENNA

EQUIVALENT DIPOLE ANTENNA

EQUIVALENT LOOP ANTENNA

EQUIVALENT DIPOLE ANTENNA

ANTENNA FOR PORTABLE RADIO DEVICE

CROSS-REFERENCE TO RELATED APPLICATIONS

This application is based upon and claims benefit of priority of Japanese Patent Applications No. Hei-11-150447 filed on May 28, 1999 and No. 2000-112436 filed on April 13, 2000, the contents of which are incorporated herein by reference.

BACKGROUND OF THE INVENTION

1. Field of the Invention

The present invention relates to an antenna for a portable radio device such as a finger-ring-type radio device which transmits signals concerning physical data of a person who wears the finger-ring-type radio device.

2. Description of Related Art

A wristwatch-type portable radio device carrying a slot antenna on its band is known. Such a slot antenna is described, for example, in the book titled "Analysis and Design of Antenna for Mobile Communication Device" (Authors: Ito, Matsuzawa and Naito; Section 5.2, Chapter 2; published in 1995 by Trikepps). However, the efficiency of such an antenna is not sufficiently high, and further improvement of such an antenna has been desired.

SUMMARY OF THE INVENTION

The present invention has been made to improve efficiency of an antenna mounted on a radio device such as a finger-ring-type radio device. The finger-ring-type radio device of the present invention is composed of a finger ring on which a slot antenna is mounted and a flat plate connected to the finger ring on which a patterned antenna and a transmission circuit for generating high frequency signals representing human physical data such as blood pressure or pulsation data are mounted.

The patterned antenna mounted on the flat plate is an antenna substantially radiating an electric-field-mode wave which has a main polarization component parallel to the surface of the plate. On the other hand, the slot antenna mounted on the finger ring is an antenna substantially radiating a magnetic-field-mode wave which has a main polarization component perpendicular to the surface of the plate. The slot antenna has a high efficiency at a position closer to a human body, while the patterned antenna has a high efficiency at a position apart from a human body. Since both the slot antenna and the patterned antenna are combined in the radio device, a high radiation efficiency is obtained at either position, close to or apart from the human body. Further, two antennas having different directivity patterns are combined, a high radiation efficiency is secured irrespective of the finger r ring directions.

To obtain a sufficient length of the slot corresponding to a frequency of a radio wave to be used, the slot may be formed in a zigzag shape. The slot antenna patterns and the feeder line patterns may be printed on both surfaces of a flexible substrate which is rounded and mounted on the finger ring. In this case, a feeder line on the front surface is preferably formed at a position overlapping another feeder line on the rear surface in order to eliminate feeder line impedance fluctuation. Further, only the feeder line portion may be extended so that the feeder lines are easily connected to the transmission circuit mounted on the flat plate.

In place of the patterned antenna mounted on the flat plate as the electric-field-mode antenna, a ground surface of the transmission circuit may be utilized. In this case, an electric-field-mode component included in the slot antenna is strengthened and coupled with the ground surface. To strengthen the electric-field-mode component in the slot antenna, the slot width is made much larger than the slot length, and unbalanced current is intentionally fed to the slot antenna.

According to the present invention, the antenna efficiency of the finger-ring-type radio device is greatly improved without making its structure complex.

Other objects and features of the present invention will become more readily apparent from a better understanding of the preferred embodiments described below with reference to the following drawings.

DETAILED DESCRIPTION OF THE PREFERRED EMBODIMENTS

Figure 1:
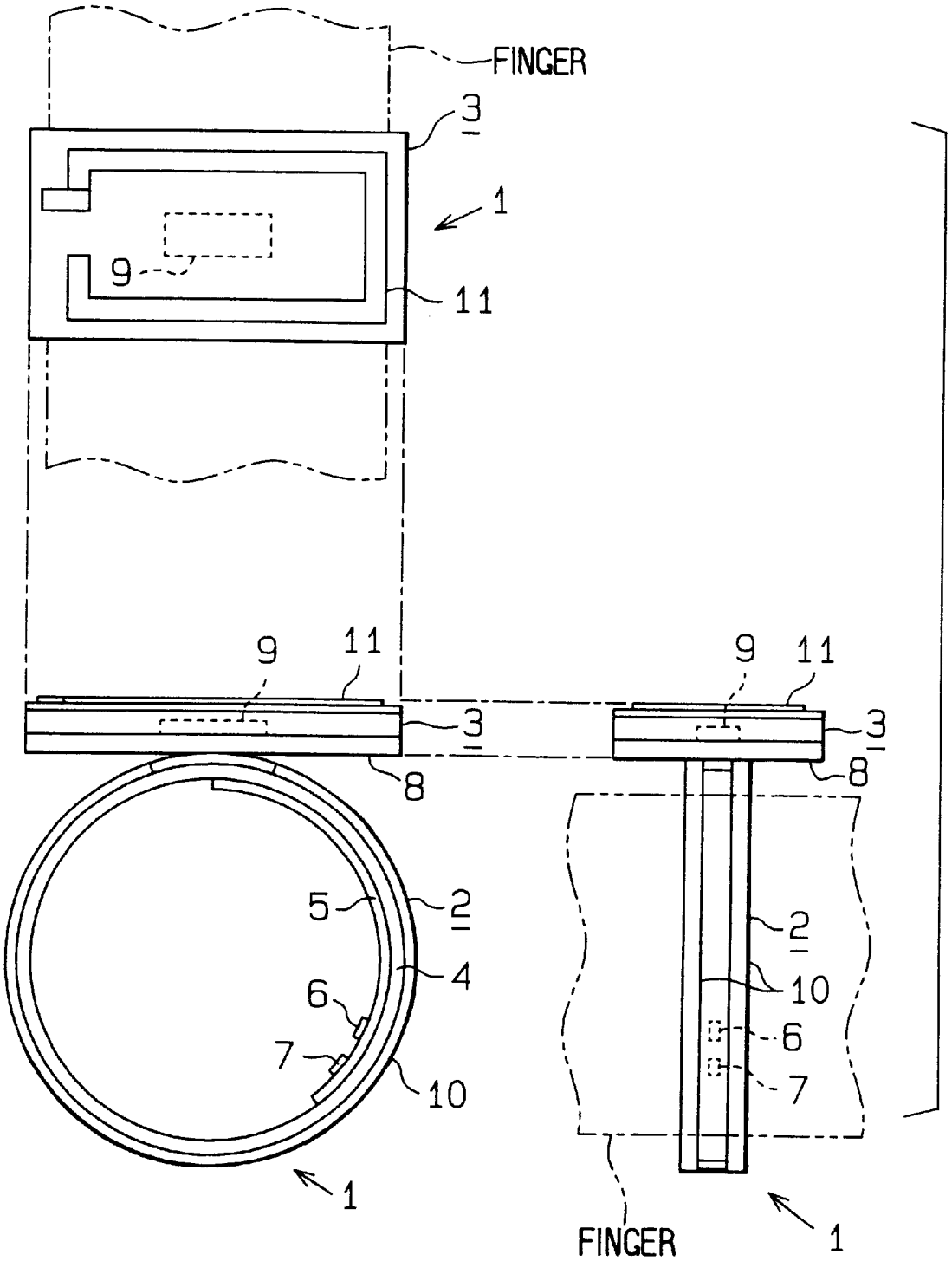
FIG. 1 shows front, top and side views of a finger-ring-type radio device as a first embodiment of the present invention.

A first embodiment of the present invention will be described in reference to FIGS. 1–5B. First, referring to FIG. 1, the whole structure of a finger-ring-type portable radio device will be described. A portable radio device 1 is composed of a ring 2 to be worn on a finger of a person and a square plate 3 mounted on the ring 2. The radio device 1 detects blood pressure and pulsation, and transmits those data from an antenna integrally mounted thereon. FIG. 1 shows front, side and top views of the radio device.

The ring 2 is composed of a circular center member 4 made of rubber or cloth, a slot antenna 10 mounted on the outer periphery of the center member 4 and a flexible substrate 5 mounted on the inside surface of the center member 4. An LED 6 and a photo diode 7 are fixed to the flexible substrate 5. The LED emits light to finger veins, and the photo diode 7 receives light reflected by the veins and converts light signals into electrical signals. Thus, the blood pulsation is detected as electrical signals.

Figure 2:
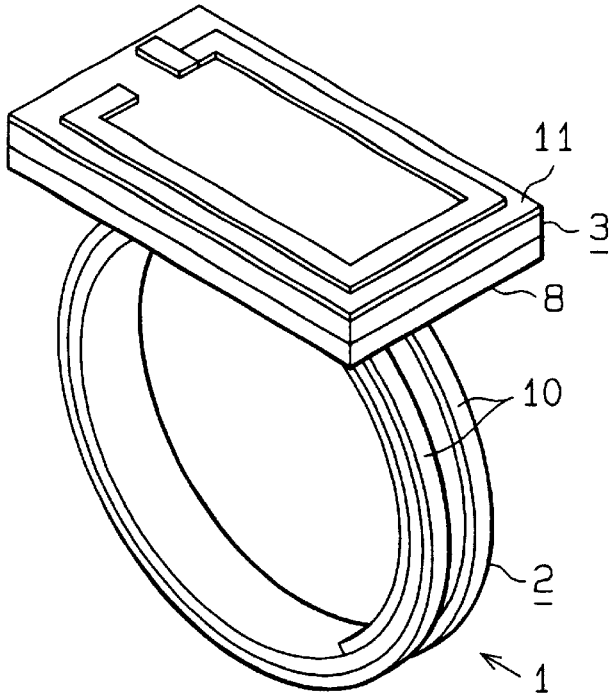
FIG. 2 is a perspective view showing the radio device shown in FIG. 1.
Figure 3:
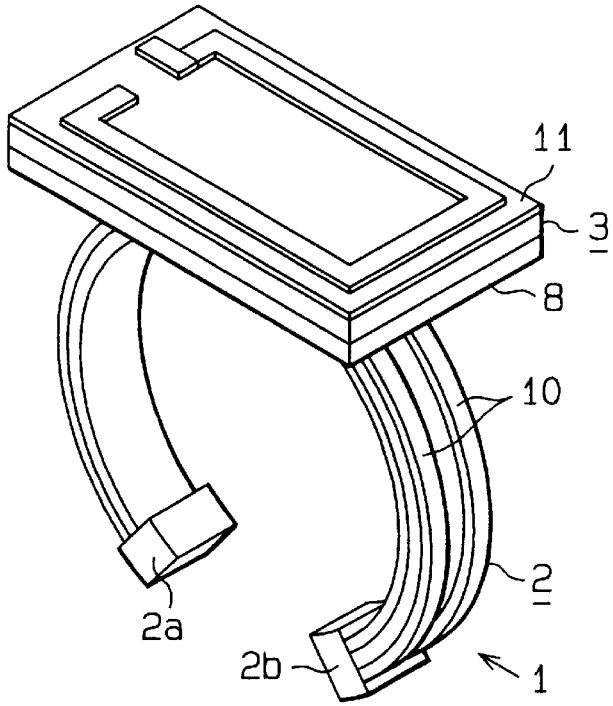
FIG. 3 is a perspective view showing a modified form of the radio device shown in FIG. 1.

The plate 3 is composed of a substrate 8 mounted on the ring 2, a transmission circuit 9 fixed to the substrate 8 and a patterned antenna (a microstrip antenna) 11. The pulsation signals are fed from the transmission circuit 9 to both the slot antenna 10 and the patterned antenna 11. The pulsation signals are transmitted from both antennas as radio waves. FIG. 2 shows a perspective view of the finger-ring-type radio device 1 shown in FIG. 1. The circular ring 2 may be partially cut out as shown in FIG. 3, and a pair of band fasteners 2*a*, 2*b* are disposed at the open ends of the ring 2.

Figure 4A:
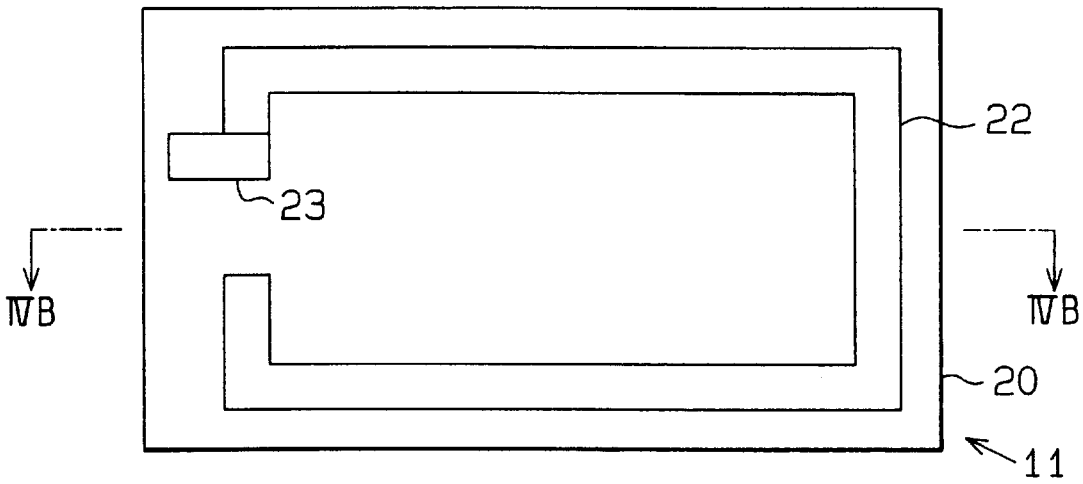
FIG. 4A is a plan view showing a patterned antenna used in the radio device.
Figure 4B:
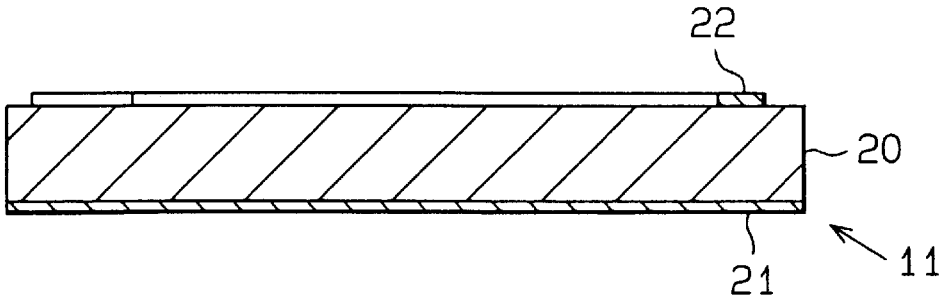
FIG. 4B is a cross-sectional view showing the patterned antenna, taken along line IVB—IVB of FIG. 4A.

Referring to FIGS. 4A–5B, the slot antenna 10 and the patterned antenna 11 will be described in detail. FIG. 4A shows a top view of the patterned antenna 11, while FIG. 4B shows a cross-sectional view thereof, taken along line IVB—IVB in FIG. 4A. The patterned antenna 11 is composed of an insulation substrate 20, an antenna pattern 22 formed on a front surface of the insulation substrate 20 and a conductor 21 covering a whole rear surface of the insulation substrate 20. A feeder line 23 is connected to one end of the antenna pattern 22.

Figure 5A:
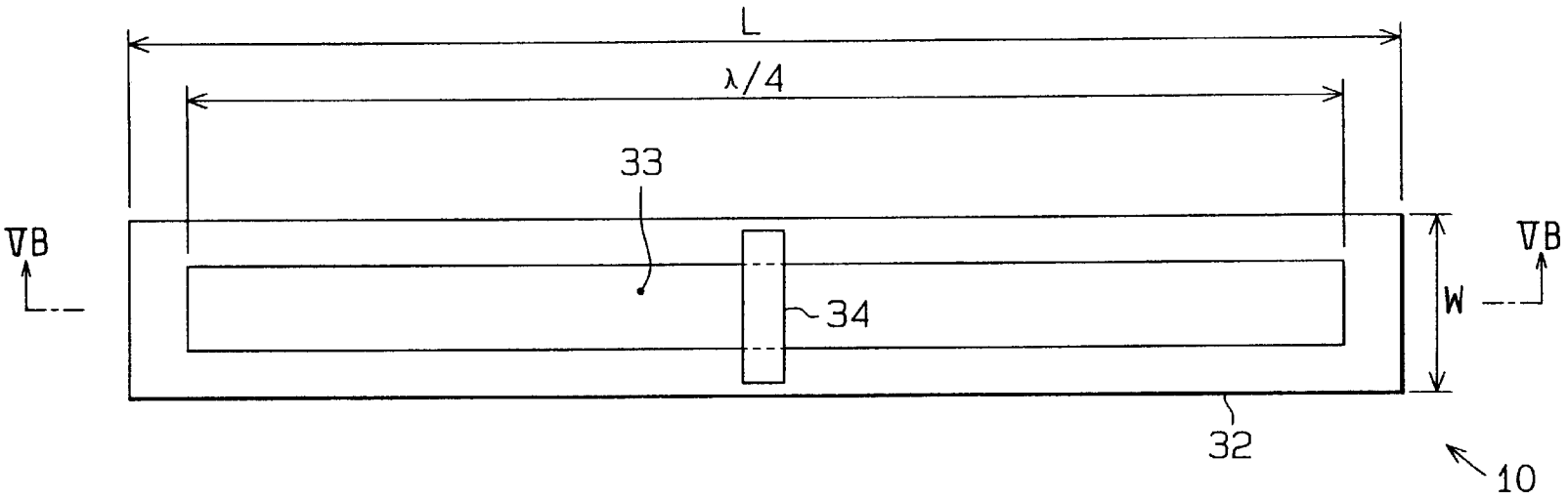
FIG. 5A is an unfolded plan view showing a slot antenna used in the radio device shown in FIG. 1.
Figure 5B:
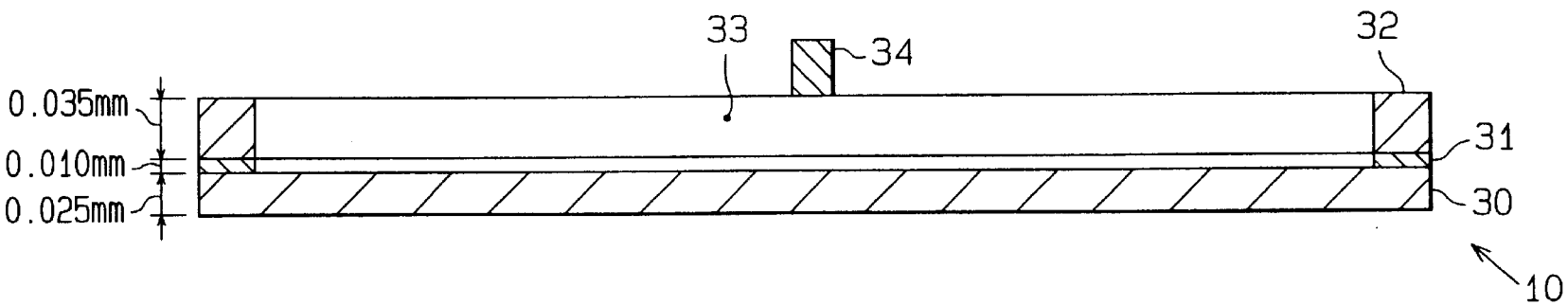
FIG. 5B is a cross-sectional view showing the slot antenna, taken along line VB—VB of FIG. 5A.

FIG. 5A shows an unfolded view of the slot antenna 10, namely, the ring-shaped slot antenna 10 is unfolded into a flat shape. FIG. 5B shows a cross-sectional view of the slot antenna 10, taken along line VB—VB in FIG. 5A. A copper foil 32 is attached on a flexible substrate 30 made of polyimide resin with an adhesive layer 31 and is connected to a feeder line. An elongate rectangular slot 33 is formed in the center of the copper foil 32. A matching capacitor 34 bridges both long sides of the copper foil 32 at its center portion. The width W of the flexible substrate 30 is 8.0 mm, its length L is 60 mm and its thickness is 0.025 mm. The copper foil 32 is 0.035 mm thick, and the adhesive layer 31 is 0.010 mm thick. The length of the slot 33 is set to $\lambda/4$, where $\lambda$ is a wavelength of a radio wave to be used.

The output of the transmission circuit 9 is fed to both the slot antenna 10 and the patterned antenna 11 connected in parallel to each other. Each impedance of the slot antenna 10 and the patterned antenna 11 is set to 100Ω, and an impedance of the transmission circuit is set to 50Ω, so that the impedance of the transmission circuit 9 matches the impedance of both antennas connected in parallel.

The patterned antenna 11 has a main polarization component which is parallel to the surface of the plate 3, and its efficiency becomes high when it takes a position apart from a body of a person wearing the ring. On the other hand, the slot antenna 10 has a main polarization component which is perpendicular to the surface of the plate 3, and its efficiency becomes high when it takes a position closer to the body. In other words, the patterned antenna 11 is an electric-field-mode antenna, while the slot antenna 10 is a magnetic-field-mode antenna.

Since the finger-ring-type radio device 1 described above has two antennas, each having a different polarized electromagnetic radiation pattern, a composite antenna efficiency can be enhanced. More particularly, the radio waves transmitted from the radio device 1 cover all the directions regardless of the direction of the ring 2, because two main polarization components having directions perpendicular to each other are combined. Further, the antenna efficiency of the radio device 1 is maintained high regardless of its distance from a human body, because the slot antenna 10 has a high efficiency at a position closer to the human body while the patterned antenna 11 has a high efficiency at a position apart from the human body.

Referring to FIGS. 6A–8, a second embodiment of the present invention will be described. In this embodiment, the slot antenna mounted on the ring 2 is modified into forms 10 shown in FIGS. 6A, 6B, 6C and 7, while other structures of the radio device 1 are the same as those of the first embodiment. FIGS. 6A, 6B, 6C and 7 show unfolded views of the slot antennas 10 in the same manner as in FIGS. 5A and SB. To obtain an appropriate slot length corresponding to a wavelength of a radio wave to be used, the slot 40 of the slot antenna 10 is formed by turning the copper foil 42.

Figures 6A, 6B, 6C:
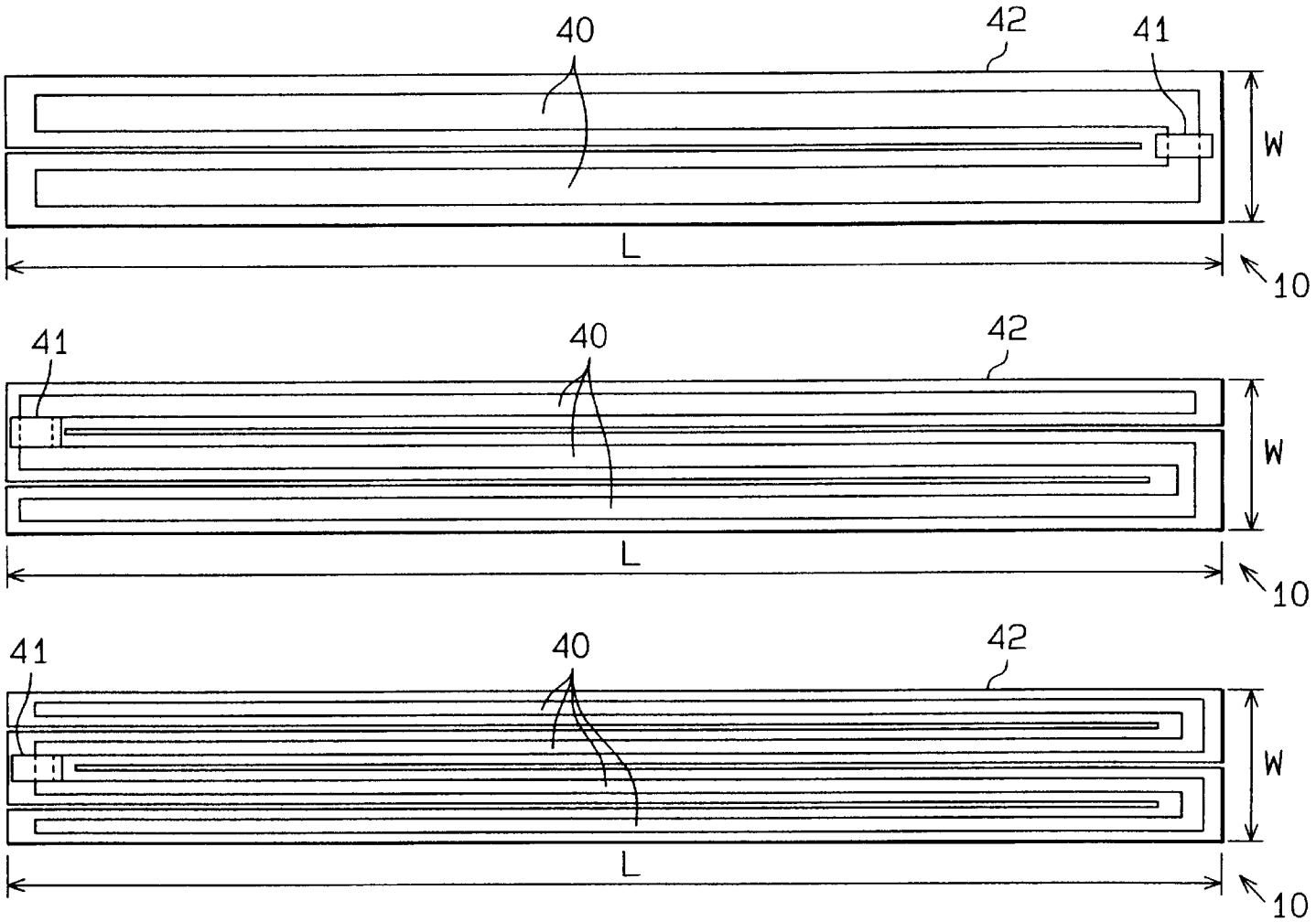
FIGS. 6A–6C are unfolded plan views respectively showing a slot antenna as a second embodiment of the present invention.
Figure 7:
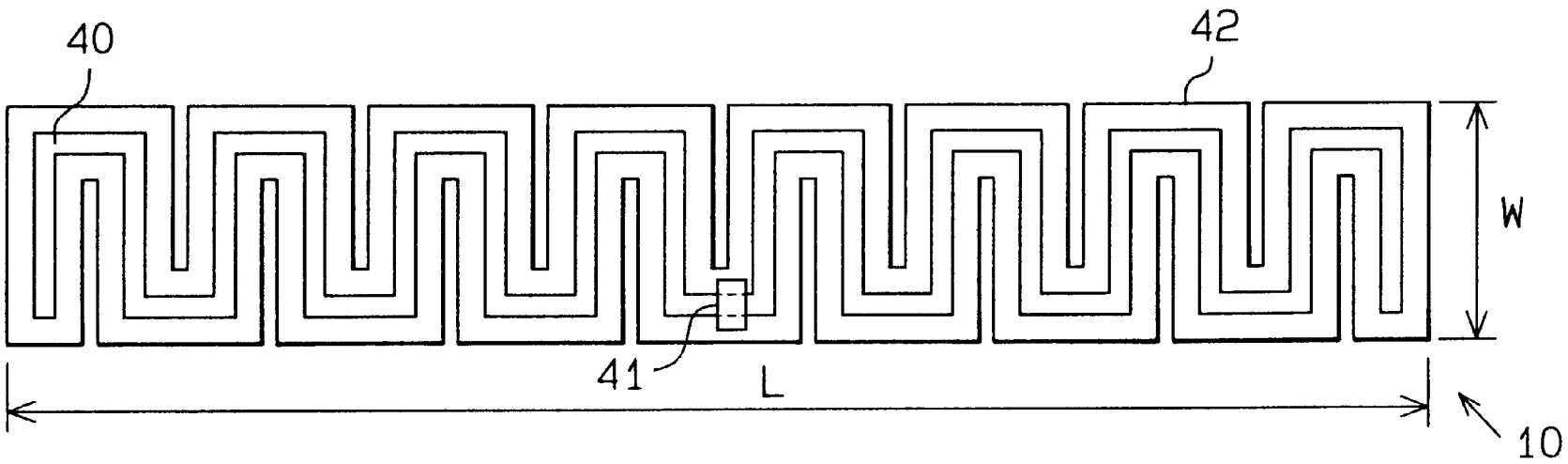
FIG. 7 is an unfolded plan view showing a modified form of the slot antenna.

In FIG. 6A, the slot 40 is turned one time to make the slot length two times of a single slot. In FIG. 6B, the slot 40 is turned two times, making the slot length three times. In FIG. 6C, the slot 40 is turned three times, making the slot length four times. The width W of the copper foil 42 is 8 mm, and its length L is 60 mm. The slot length is about $\frac{1}{8}\lambda$ in FIG. 6A, about $\frac{3}{16}\lambda$ in FIG. 6B and about $\frac{1}{4}\lambda$ in FIG. 6C, where $\lambda$ is a wavelength of the radio wave to be used. In FIG. 7, the copper foil 42 is formed in a zigzag shape, making the slot 40 also in a zigzag shape.

The matching capacitor 41 is placed at the center of the slot 40 in each form of the slot antenna 10, so that the capacitor 41 is positioned underneath the center of the plate 3, and thereby a projection formed by the capacitor 41 is 5 hidden by the plate 3. Further, the antenna impedance can be easily matched because the patterned antenna 11 is symmetrically positioned with respect to the matching capacitor 41.

Figure 8:
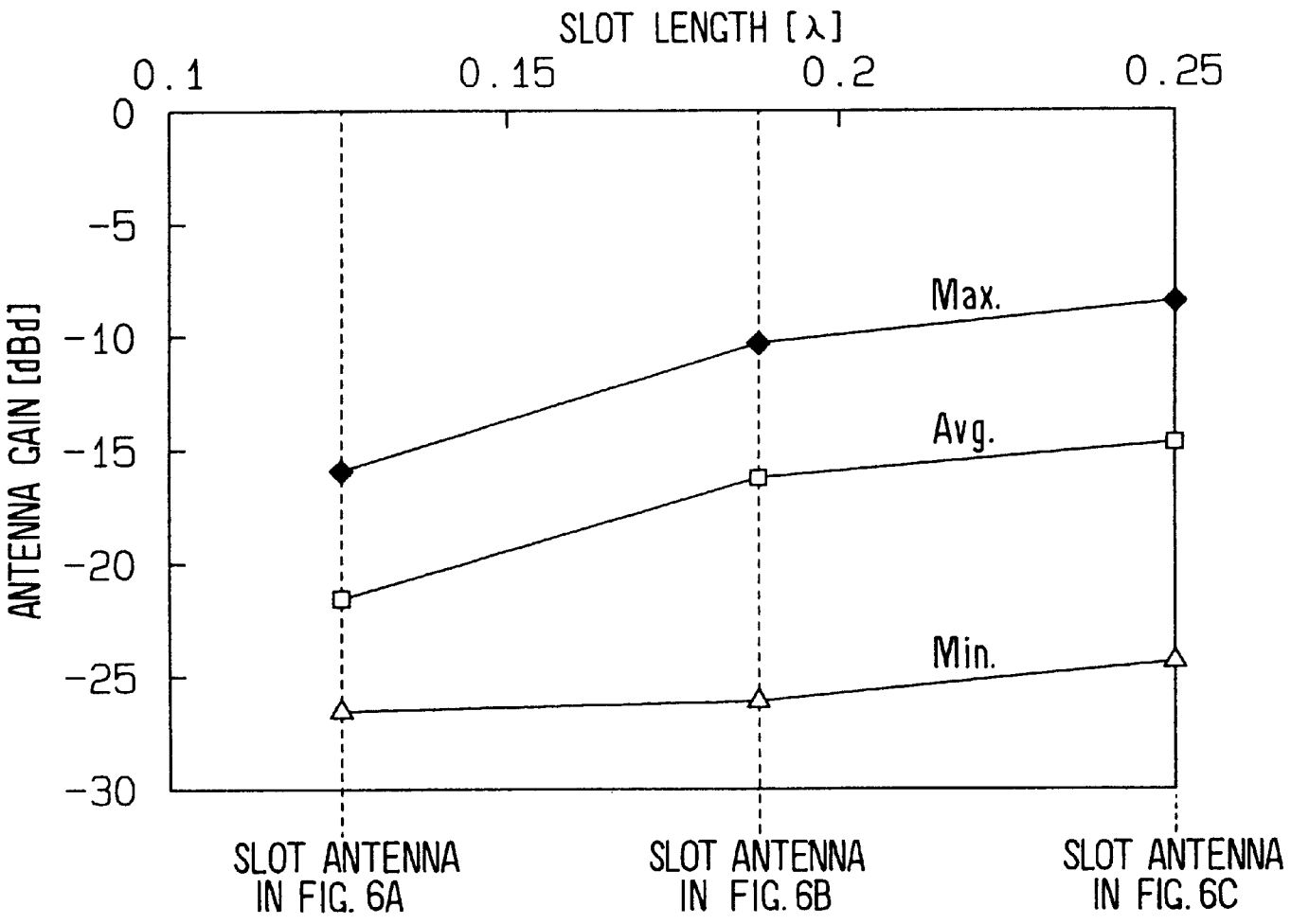
FIG. 8 is a graph showing a slot antenna gain versus a slot length of the slot antenna.

FIG. 8 shows a relative gain of the respective slot antennas shown in FIGS. 6A–6C. The relative gain is shown on the ordinate in terms of dBd, and the respective slot antennas are shown on the abscissa in terms of the slot length counted by the wave length$\lambda$. In the graph, an upper line, a middle line and a lower line show a maximum gain, an average gain and a minimum gain, respectively. It is seen from the graph that the antenna gain increases as the slot length increases. It is advantageous to provide a longer antenna length by turning the slot 40. The slot antenna 10 and the patterned antenna 11 connected in parallel to each other are connected to the transmission circuit 9 in the same manner as in the first embodiment.

Since an appropriate slot length corresponding to a wavelength in use is provided by turning the slot 40 in a zigzag shape in the second embodiment, a higher antenna efficiency is obtained. In other words, the slot length that is otherwise limited by the peripheral length of the ring 2 is extended by turning the slot 40, and thereby the slot antenna efficiency is increased. Since the slot antenna 10 and the patterned antenna 11, each having a different polarized electromagnetic radiation pattern, are combined, the overall antenna efficiency of the radio device 1 is further improved.

Figure 9A:
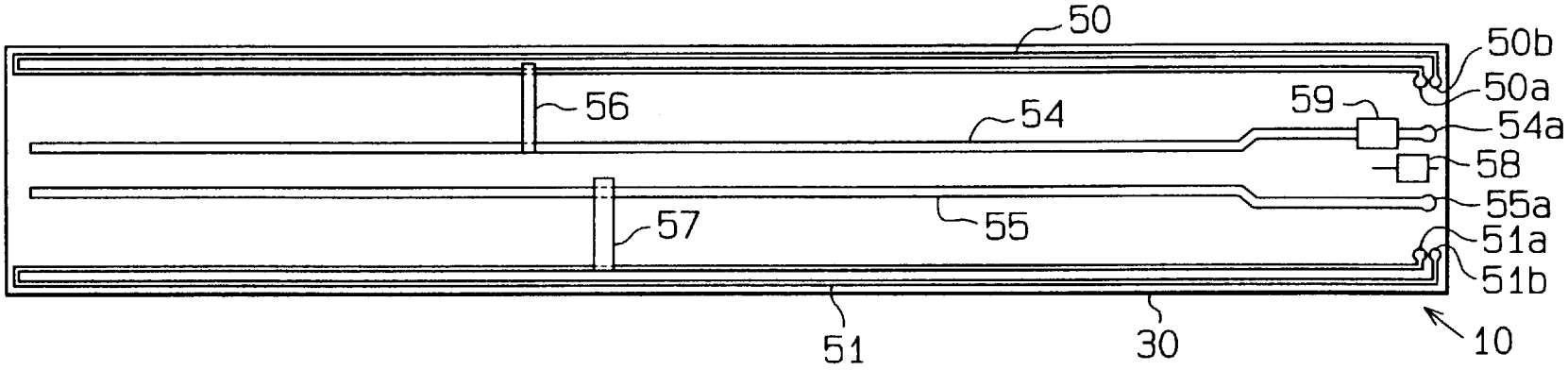
FIG. 9A is a plan view showing a rear surface of a slot antenna as a third embodiment of the present invention.
Figure 9B:
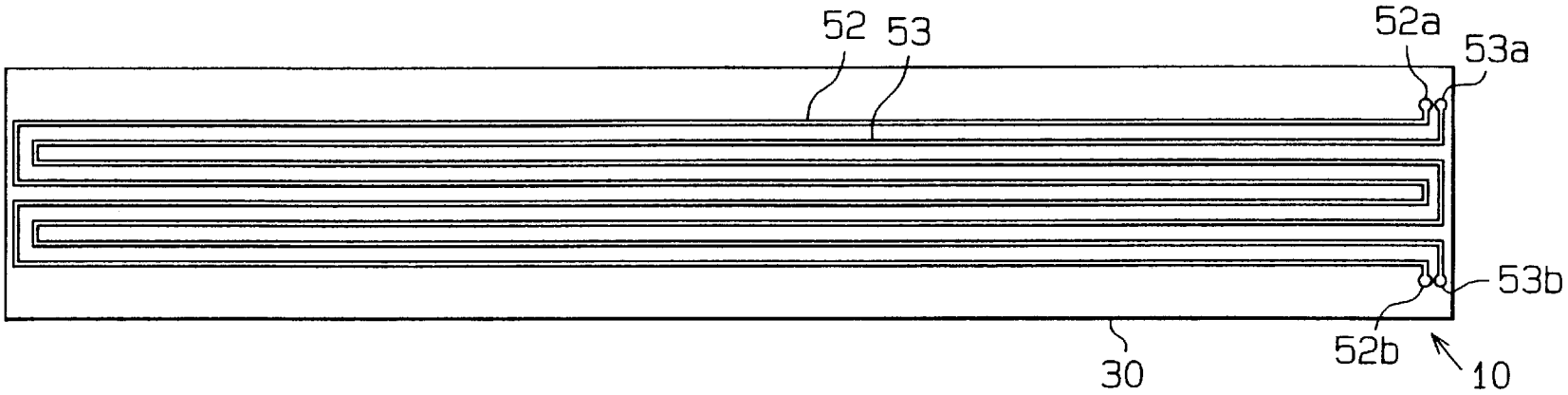
FIG. 9B is a plan view showing a front surface of the slot antenna shown in FIG. 9A.

A third embodiment of the present invention will be described in reference to FIGS. 9A and 9B. In this embodiment, the structure of the slot antenna 10 is changed from that of the first embodiment, and other structures of the finger-ring-type radio device 1 are the same as those of the first embodiment. FIG. 9A shows a rear surface (an inner surface) of the flexible substrate 30 on which copper foil antenna patterns 50, 51, copper foil feeder lines 54, 55 and other components are formed. FIG. 9B shows a front surface (an outer surface) of the flexible substrate 30 on which copper foil antenna patterns 52, 53 are formed.

The copper foil antenna patterns 50, 51 are formed on the rear surface of the flexible substrate 30 along the long sides thereof as shown in FIG. 9A. The copper foil antenna patterns 52, 53 are formed on the front surface of the flexible substrate 30 in the inside portion thereof as shown in FIG. 9B. The antenna pattern 50 has a couple of pattern ends 50*a*, 50*b*, and the antenna pattern 51 has a couple of antenna ends 51*a*, 51*b*. Similarly the antenna pattern 52 has a couple of pattern ends 52*a*, 52*b*, and the antenna pattern 53 has a couple of antenna ends 53*a*, 53*b*. The antenna ends 50*a* and 52*a*; 50*b* and 53*a*; 51*a* and 52*b*; and 51*b* and 53*b*; are respectively connected to each other through through-holes formed on the flexible substrate 30. The copper foil feeder lines 54, 55 are also formed on the rear surface of the flexible substrate 30 at the inside portion of the antenna patterns 50, 51. Jumpers 56, 57 for connecting the feeder lines 54, 55 to the antenna patterns 50, 51, respectively, are also formed on the rear surface of the flexible substrate 30. Feeder pads 54*a*, 55*a* are formed at the end portions of the feeder lines 54, 55, respectively.

The jumpers 56, 57 are positioned to properly adjust impedances of the antenna patterns and the feeder lines. To determine the proper positions of jumpers 56, 57, they are preliminarily placed in an experimental manufacturing process. After their proper positions are determined, their positions are fixed into a pattern to be printed for mass production. All the antenna patterns, feeder lines and jumpers are printed in a fixed pattern on both surfaces of the flexible substrate 30, and then both surfaces are coated with protection layers such as resin layers. Then, the flexible substrate 30 is rounded into a ring shape.

High frequency signals are fed to the slot antenna from the transmission circuit 9 through the following path: feeder pads 54*a*, 55*a*→feeder lines 54, 55→jumpers 56, 57→antenna patterns 50, 51→antenna patterns 52, 53. A matching capacitor 58 disposed on the rear surface of the flexible substrate 30 as shown in FIG. 9A is connected between the antenna patterns 52 and 53 through holes formed in the flexible substrate 30. A resistor 59 is disposed in the feeder line 54 formed on the rear surface of the flexible substrate 30, as shown in FIG. 9A.

Since the antenna patterns 50, 51, 52, 53, feeder lines 54, 55, and jumpers 56, 57 are all formed in a printing process after the positions of the jumpers are determined to properly set the antenna impedance, the slot antenna 10 is suitable for mass production.

Figure 10A:
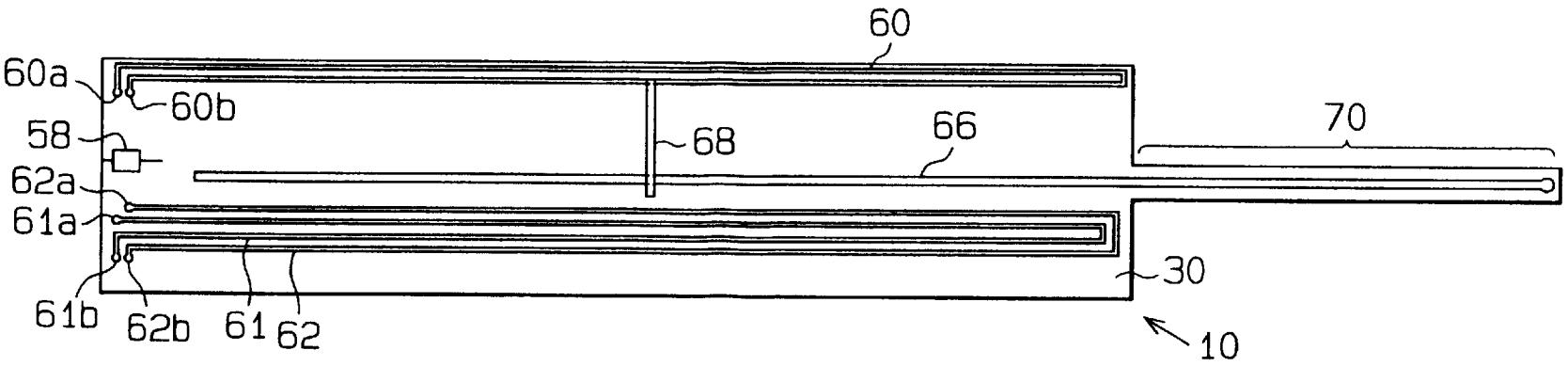
FIG. 10A is a plan view showing a rear surface of a slot antenna as a fourth embodiment of the present invention.

A fourth embodiment of the present invention will be described in reference to FIGS. 10A and 10B. This embodiment is similar to the third embodiment described above, except that the feeder lines are formed on both surfaces of the substrate 30 and extended therefrom and that the antenna patterns are formed in a different shape. FIG. 10A shows a rear surface of the substrate 30, and FIG. 10B shows a front surface of the substrate 30.

Three antenna patterns 60, 61 and 62 made of copper foils are formed on the rear surface of the substrate 30 as shown in FIG. 10A. The antenna pattern 60 has pattern ends 60*a*, 60*b*; the antenna pattern 61 has pattern ends 61*a*, 61*b*; and the antenna pattern 62 has pattern ends 62*a*, 62*b*. The substrate 30 is elongated into a narrow elongate portion 70. A copper foil feeder line 66 is formed in the center of the substrate 30 and is extended to the narrow elongate portion 70. A jumper 68 for connecting the feeder line 66 to the antenna pattern 60 and a matching capacitor 58 are also formed on the rear surface of the substrate as shown in FIG. 10A.

Figure 10B:
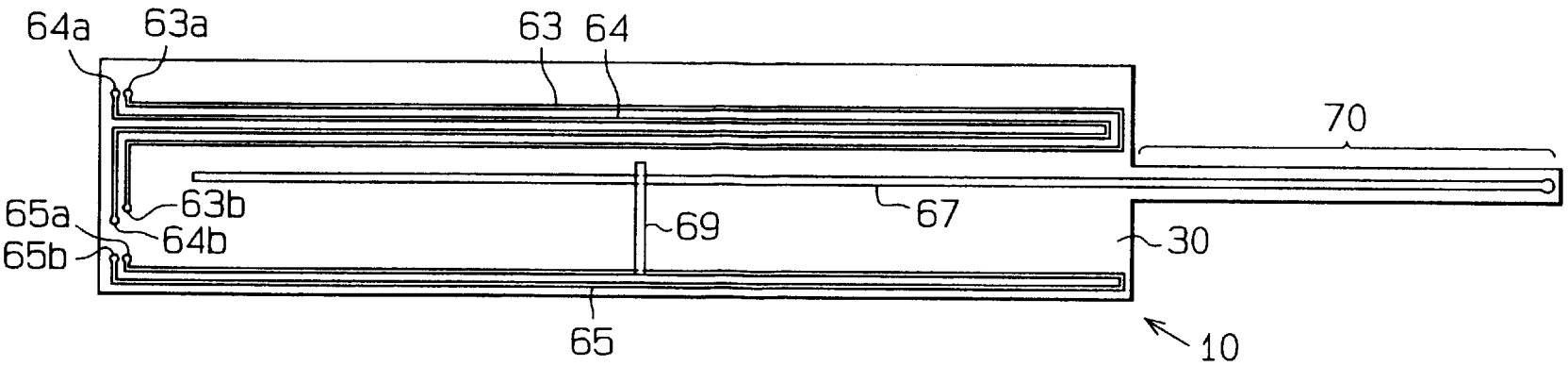
FIG. 10B is a plan view showing a front surface of the slot antenna shown in FIG. 10A.

Three antenna patterns 63, 64 and 65 made of copper foils are formed on the front surface of the substrate 30 as shown in FIG. 10B. The antenna pattern 63 has pattern ends 63*a*, 63*b*; the antenna pattern 64 has pattern ends 64*a*, 64*b*; and the antenna pattern 65 has pattern ends 65*a*, 65*b*. A copper foil feeder line 67 is formed in the center of the substrate 30 and is extended to the narrow elongate portion 70. A jumper 69 for connecting the feeder line 67. to the antenna pattern 65 is also formed on the front surface of the substrate 30 as shown in FIG. 10B.

The antenna pattern ends 60*a* and 64*a*; 60*b* and 63*a*; 62*a* and 63*b*; 61*a* and 64*b*; 61*b* and 65b; and 62b and 65a are connected to each other, respectively, through holes formed in the substrate 30. The feeder line 66 formed on the rear surface and the feeder line 67 formed on the front surface are positioned along the center line of the substrate 30, so that they overlap each other. The high frequency signals from the transmission circuit 9 are fed to the feeder lines 66, 67 at their right side ends shown in FIGS. 10A and 10B.

The high frequency signals are fed to the slot antenna 10 through the following path: feeder lines 66, 67→jumpers 68, 69→antenna patterns 60, 65→antenna patterns 63, 64, 61, 62. The matching capacitor 58 disposed on the rear surface of the substrate 30 is connected between the antenna patterns 63 and 64 through holes formed in the substrate 30.

Since the feeder lines 66 and 67 are positioned to overlap each other, interference between two feeder lines causing impedance fluctuations is avoided, and the feeder line impedance is kept at a constant level. When the impedances of the transmission circuit 9, the feeder lines and the antenna patterns are all matched at a same value, e.g., 50Ω, signals are most effectively transmitted from the antenna. If the feeder line impedance fluctuates and shifts from that value, transmission power reflection occurs and thereby the transmission power decreases. Therefore, it is necessary to make impedance matching of the feeder lines. Since the feeder lines are formed on the extended narrow portion 70, the slot antenna 10 itself can be disposed in the finger-ring belt and the feeder lines can be easily connected to the transmission circuit 9 disposed in the plate 3.

Though the slot antenna 10 and patterned antenna 11 are combined in the foregoing embodiments, it is also possible to use the slot antenna alone. The slot antenna 10 may not be formed into a complete circle, but it may be formed in a half ring having a wide opening, e.g., in a ring covering an angle of 90 degrees or 60 degrees.

Figure 11:
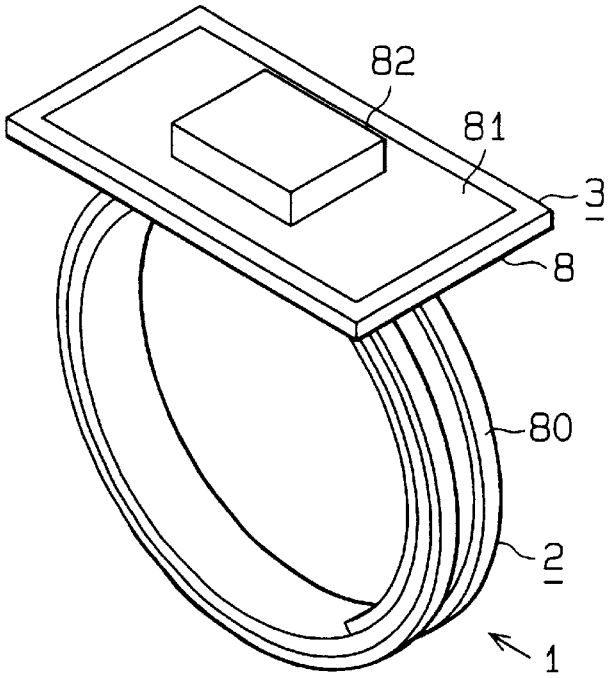
FIG. 11 is a perspective view showing a finger-ring-type radio device as a fifth embodiment of the present invention.
Figure 12:
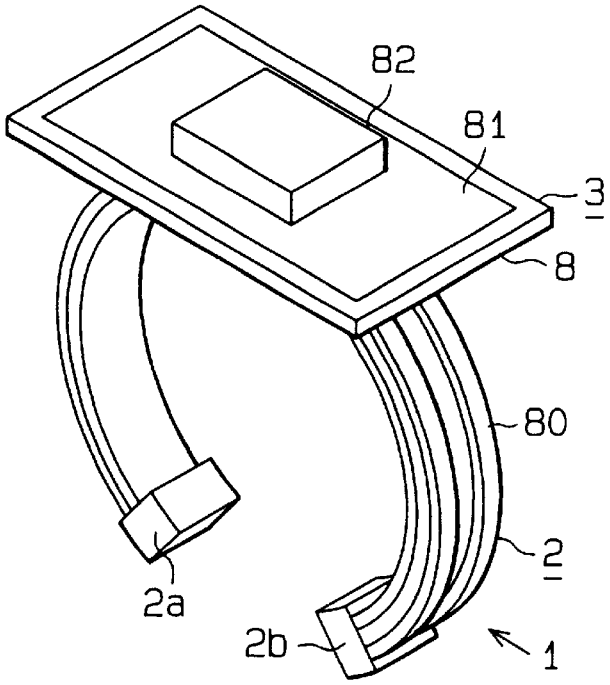
FIG. 12 is a perspective view showing a modified form of the slot antenna shown in FIG. 11.

Referring to FIGS. 11–14B, a fifth embodiment of the present invention will be described. This embodiment is similar to the first embodiment, but the patterned antenna 11 disposed on the plate 3 in the first embodiment is replaced with a ground surface 81 formed on the plate 3 as shown in FIG. 11. The ground surface 81 is formed on the polyimide substrate 8, and a transmission circuit 82 is disposed thereon. A slot antenna 80 is disposed on the outer periphery of the ring 2 in the same manner as in the first embodiment. The ground surface 81 and the transmission circuit 82 are connected to the slot antenna 80. The ground surface 81 defines a ground potential and gives the ground potential to one point of the slot antenna 80. High frequency signals are fed to another point of the slot antenna 80. The complete ring 2 shown in FIG. 11 may be modified to a ring having an opening as shown in FIG. 12. The open end of the ring 2 in FIG. 12 is fastened by fasteners 2*a*, 2*b*.

Figure 13:
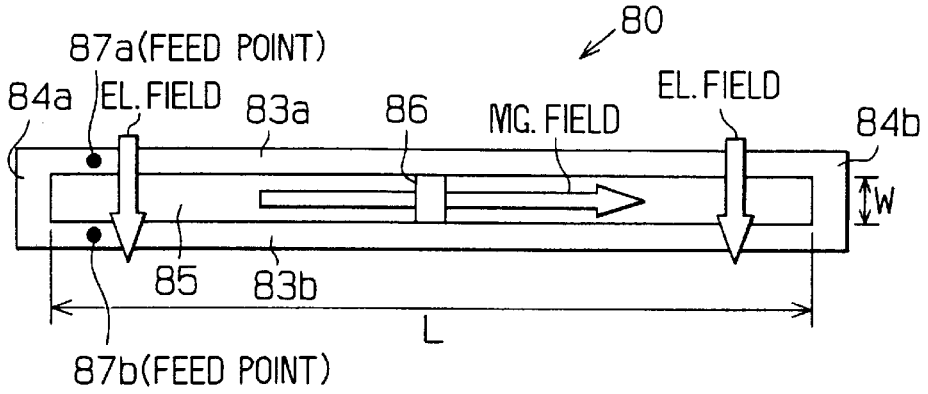
FIG. 13 is an unfolded plan view showing a slot antenna used in the radio device shown in FIG. 11.

FIG. 13 shows an unfolded view of the slot antenna 80. A couple of long side patterns 83*a*, 83*b*, and a couple of short side patterns 84*a*, 84*b*, all made of copper foil, form a square antenna pattern. An elongate slot 85 is formed by those four side patterns. Both long side patterns 83*a* and 83*b* are connected by a matching capacitor 86. The antenna 80 is fed from feeding points 87*a*, 87*b* through unbalanced lines which allow unbalanced current. Thus, the slot antenna 80 is coupled with the ground surface 81 and is mounted on the ring 2 as shown in FIGS. 11 and 12. Accordingly, the slot antenna 80 is not integral with the ground surface 81 and the transmission circuit 82, though it is electrically coupled with those elements.

Figure 14A:
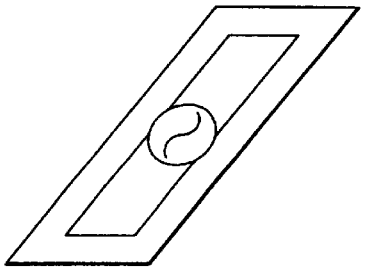
FIGS. 14A and 14B are schematic views respectively showing a slot antenna and a dipole antenna, both of which are equivalent to the antenna shown in FIG. 11.
Figure 14B:
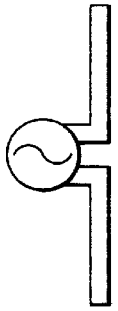

Since the unbalanced current is allowed in feeding the slot antenna 80, the ground surface 81 is utilized as a part of an electric-field-mode antenna coupled with a magnetic-field-mode antenna. Since the slot antenna 80 is disposed separately from the substrate 8, it effectively acts also as an electric-field-mode antenna. More particularly, the antenna of this embodiment includes two antenna modes, a magnetic-field-mode of a slot antenna and an electric-field-mode of a dipole antenna, as shown in FIGS. 14A and 14B as their equivalents. Therefore, a high gain is obtained both at a vicinity of a human body and at a position apart therefrom. This is because the electric-field-mode antenna achieves a high gain when it is positioned apart from a human body, while the magnetic-field-mode antenna achieves a high gain at a vicinity of a human body. Therefore, this antenna is advantageous when it is used as a finger-ring-type antenna. Further, since it is not necessary to mount a patterned antenna on the plate 3, the antenna structure is simplified.

JP-A-7-231217 proposes to use two loop antennas to radiate both the vertically and horizontally polarized waves for improving directivity of an antenna. Also, an article entitled "SLOT-DIPOLE ANTENNA" (published for 1984 meeting of Optics and Electromagnetic Wave Division of Electronics and Communication Institute) proposes an antenna having both of a magnetic-field-mode and an electric-field-mode (page I-81). However, those antennas require two antenna elements, and a larger space for mounting two elements is necessary. In the case where two loop antennas are used, the antenna gain decreases at a position more than ¼λ apart form a human body though it is high at a vicinity of a human body, because the loop antenna is a magnetic-field-mode antenna. In the case where an electric-field-mode antenna is added to a magnetic-field-mode antenna, the antenna size as a whole becomes bulky.

Since the antenna as the fifth embodiment of the present invention is structured based on a magnetic-field-mode antenna, and the ground surface 81 is utilized in addition to the electric-field-mode of the slot antenna 80, both the vertically and horizontally polarized waves are formed without using two antenna elements. Further, a high antenna gain is obtained at both a vicinity of a human body and at a position apart form the human body.

Figure 15:
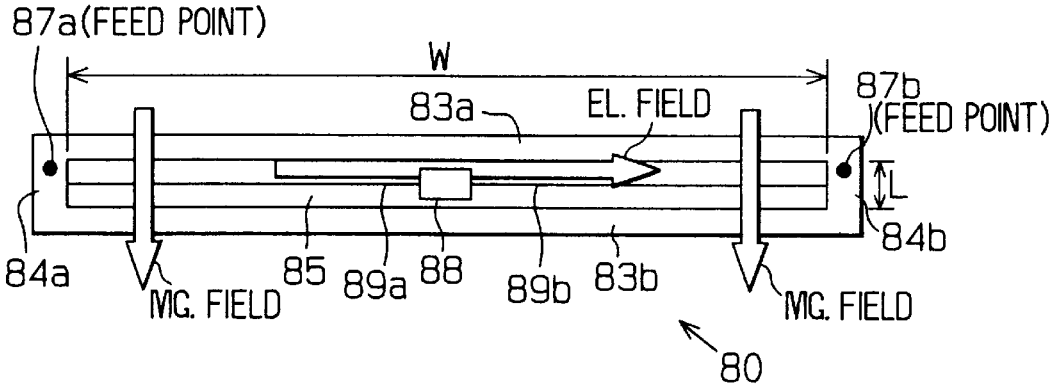
FIG. 15 is an unfolded plan view showing a slot antenna as a sixth embodiment of the present invention.

A sixth embodiment of the present invention will be described in reference to FIG. 15. The copper foil pattern consisting of two long sides 83*a*, 83*b* and two short sides 84*a*, 84*b* is the same as that of the fifth embodiment shown in FIG. 13, but a matching capacitor 88 is connected between the short sides 84*a*, 84*b* through connecting lines 89*a*, 89*b*. By connecting the matching capacitor in this manner, the direction of the elongate slot 85 having a slot length L and slot width W shown in FIG. 13 is reversed to form a wide and short slot 85 shown in FIG. 15. Feed points 87*a*, 87*b* are changed as shown in FIG. 15 to make impedance matching. In the slot antenna 80 shown in FIG. 15, the electric-field-mode component is generated in the direction of slot width W, while the magnetic-field-mode component is generated in the direction of slot length L. The magnetic-field-mode component is weakened while the electric-field-mode component is strengthened, compared with those of the slot antenna shown in FIG. 13. That is, the electric-field-mode component of the slot antenna which is originally a magnetic-field-mode antenna is strengthened by widening the slot width W.

As the electric-field-mode component becomes strong, the slot antenna 80 can be easily coupled with the transmission circuit 82 and the ground surface 81, and thereby a dipole antenna constituted by a part of the slot antenna 80 and the ground surface 81 and having the electric-field-mode is effectively formed.

Figure 16A:
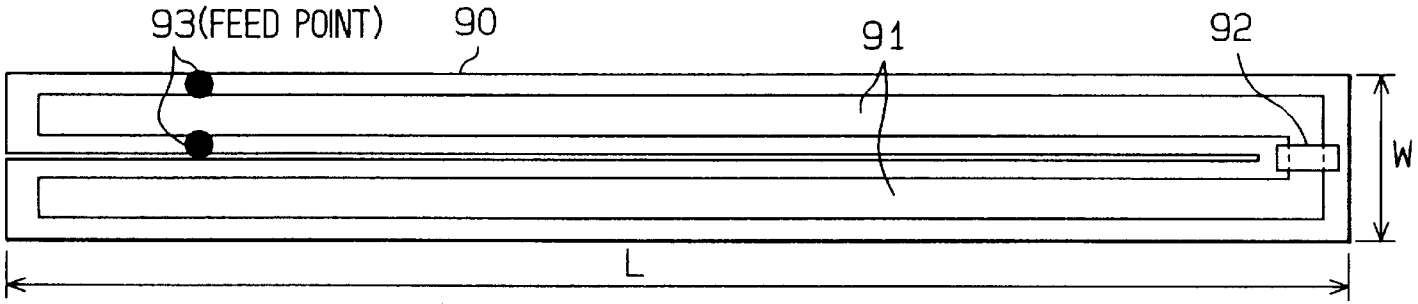
FIGS. 16A–16C are unfolded plan views respectively showing a slot antenna as a seventh embodiment of the present invention.
Figure 16B:
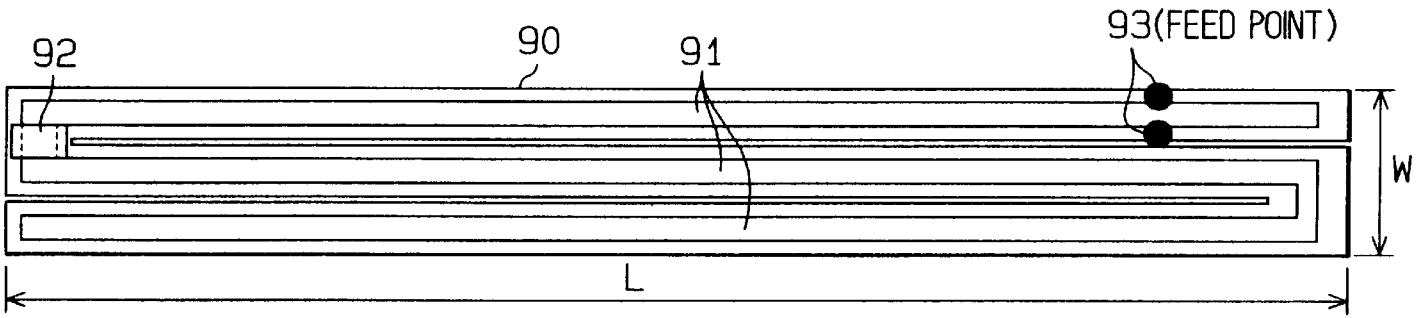
Figure 16C:
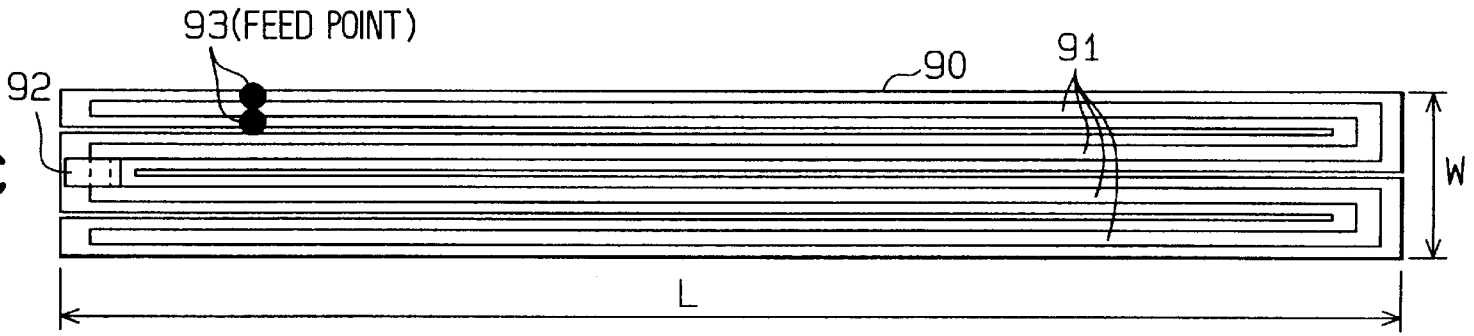
Figure 17:
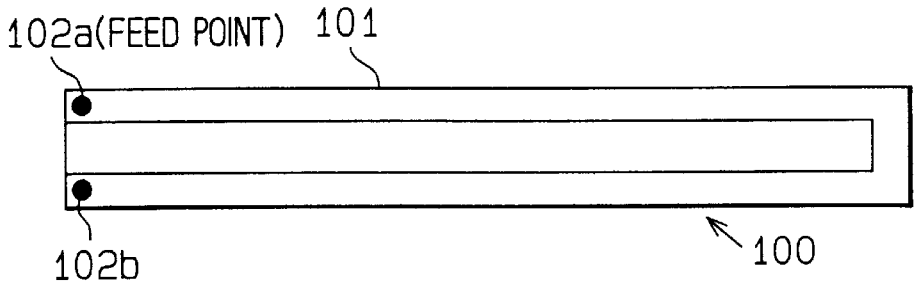
FIG. 17 is an unfolded plan view showing a loop antenna used in the finger-ring-type radio device, as an eighth embodiment of the present invention.

A seventh embodiment of the present invention will be described in reference to FIGS. 16A, 16B and 16C. In this embodiment, the slot 85 of the slot antenna 80 of the fifth embodiment shown in FIG. 13 is extended by turning it at the longitudinal end or ends thereof. In FIG. 16A, the length of the slot 91 is made two times of the single slot by turning it once at its longitudinal end. In FIG. 16B, the slot length is made three times by turning it two times. In FIG. 16C, the slot length is made four times by turning it three times. In respective slot antennas shown in FIGS. 16A–16C, a matching capacitor 92 connecting antenna patterns 90 is placed at a substantial center portion of the slot 91, and feed points 93 are respectively positioned on the antenna patterns 90 as shown in those figures.

Since the slot length is enlarged by turning the slot 91, the same advantages as in the second embodiment are achieved in this embodiment, too. In addition, since the electric-field-mode component in the slot antenna 90 is strengthened, the ground surface 81 is effectively coupled with the electric-field-mode component of the slot antenna 90. More particularly, the slot antenna length corresponding to a radio frequency of 300 MHz is secured by turning the slot 90. Further, the electric-field-mode radiation in the radio device 1 is effectively obtained by coupling the electric-field-mode component of the slot antenna 80 with the transmission circuit 82 and the ground surface 81.

Figure 18:
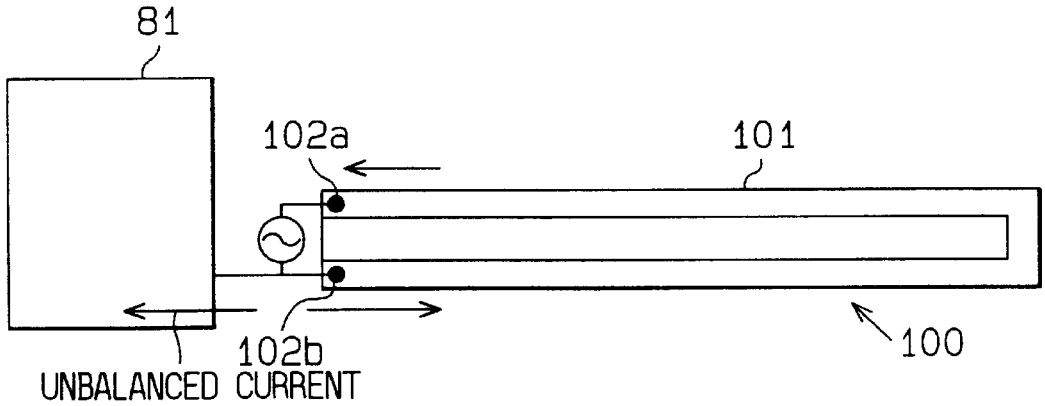
FIG. 18 is a schematic view showing connection between the loop antenna shown in FIG. 17 and a ground plane.
Figure 19A:
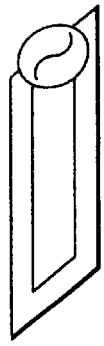
FIGS. 19A and 19B are schematic views respectively showing a loop antenna and a dipole antenna, both of which are equivalent to the antenna shown in FIG. 18.
Figure 19B:
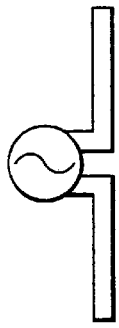

An eighth embodiment of the present invention is shown in FIGS. 17–19B. In this embodiment, the square antenna pattern of the fifth embodiment shown in FIG. 13 is replaced with an antenna pattern 101 shown in FIG. 17. That is, the loop antenna 100 is mounted on the ring 2 shown in FIGS. 11 or 12 in place of the slot antenna 80. Feed points 102*a*, 102*b* are positioned at both ends of the antenna pattern 101, and unbalanced current is allowed to flow as shown in FIG. 18, thus coupling the loop antenna 100 with the ground surface 81. The loop antenna 100 functions as the magnetic-field-mode antenna, and the electric-field-mode is added by the function of a dipole mode antenna formed by coupling the loop antenna 100 with the ground surface 81. An equivalent loop antenna as the magnetic-filed-mode antenna and an equivalent dipole antenna as the electric-field-mode antenna are shown in FIG. 19A and FIG. 19B, respectively.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An antenna for a portable radio device including a transmission circuit, the antenna comprising:

a slot antenna connected to the transmission circuit, the slot antenna having an antenna pattern and a slot for radiating a radio wave, wherein:

the slot is turned in a longitudinal direction thereof so that the antenna pattern is also turned while leaving an elongate space between the turned antenna pattern, thereby securing a slot length that corresponds to a wave length of the radio wave to be radiated.

2. The antenna for a portable radio device as in claim 1, wherein:

the portable radio device is a finger-ring-type device having a ring to be worn by a person, and the slot antenna is mounted on the ring.

3. The antenna for a portable radio device as in claim 2, wherein:

the slot antenna comprises a plurality of antenna patterns for respectively defining the slot, the antenna patterns being formed on both front and rear surfaces of the ring, and feeder line patterns for connecting the transmission circuit to the antenna patterns, the feeder line patterns being formed on at least either the front or the rear surface of the ring.

4. The antenna for a portable radio device as in claim 3, wherein:

the feeder line patterns are formed on both the front and the rear surfaces of the ring.

5. The antenna for a portable radio device as in claim 1, wherein:

the antenna further includes another antenna that has a radiation pattern different from that of the slot antenna; and the radiation patterns of the slot antenna and the other antenna are combined to form a composite radiation pattern.

6. The antenna for a portable radio device as in claim 5, wherein:

the radio device is a finger-ring-type device having a ring to be worn by a person and a plate mounted on the ring; and the slot antenna is mounted on the ring and the other antenna is mounted on the plate.

7. An antenna for a portable radio device including a transmission circuit, the antenna comprising:

a slot antenna connected to the transmission circuit, the slot antenna having a slot for radiating a radio wave, wherein:

the slot is turned in a longitudinal direction thereof, thereby securing a slot length that corresponds to a wave length of the radio wave to be radiated, the portable radio device is a finger-ring-type device having a ring to be worn by a person, and the slot antenna is mounted on the ring, the slot antenna comprises antenna patterns for defining the slot, the antenna patterns being formed on both front and rear surfaces of the ring, and feeder line patterns for connecting the transmission circuit to the antenna patterns, the feeder line patterns being formed on at least either the front or the rear surface of the ring, the antenna patterns and the feeder line patterns are connected through jumpers; and positions of the jumpers are adjusted to set an impedance of the slot antenna to an optimum value and then the positions thereof are fixed by forming the jumpers as fixed patterns.

8. An antenna for a portable radio device including a transmission circuit, the antenna comprising:

a slot antenna connected to the transmission circuit, the slot antenna having a slot for radiating a radio wave, wherein:

the slot is turned in a longitudinal direction thereof, thereby securing a slot length that corresponds to a wave length of the radio wave to be radiated, the portable radio device is a finger-ring-type device having a ring to be worn by a person, and the slot antenna is mounted on the ring;

the slot antenna comprises: antenna patterns for defining the slot, the antenna patterns being formed on both front and rear surfaces of a substrate; a first feeder line pattern formed on the front surface for connecting the transmission circuit to the antenna patterns formed on the front surface; and a second feeder line pattern formed on the rear surface for connecting the transmission circuit to the antenna patterns formed on the rear surface;

the first and the second feeder line patterns are formed at an overlapping position on the substrate, so that an impedance of the feeder line patterns is kept at a constant level; and the first and the second feeder line patterns include respective end points formed at an overlapping position on the substrate, so that the transmission circuit is connected to the first and the second feeder line patterns at the end points.

9. The antenna for a portable radio device as in claim 8, wherein:

a portion of the substrate on which only the feeder line patterns are formed is extended from a portion on which both the antenna patterns and the feeder line patterns are formed, forming a narrow elongate portion; and the end points of the feeder line patterns are formed at an end portion of the narrow elongate portion.

10. An antenna for a portable radio device having a transmission circuit including a ground surface, the antenna comprising:

a magnetic-field-mode antenna including an electric-field-mode element as a part thereof; and an electric-field-mode antenna formed by the ground surface and the electric-field-mode element in the magnetic-field-mode antenna, the ground surface being coupled with the electricfield-mode antenna by allowing unbalanced current to flow into the magnetic-field-mode antenna, thereby providing a small electric dipole.

11. The antenna for a portable radio device as in claim 10, wherein:

an antenna selected form a group consisting of a slot antenna and a loop antenna is used as the magnetic-field-mode antenna; and the magnetic-field-mode antenna is positioned apart from the transmission circuit and the ground surface thereof, so that the electric-field-mode element in the magneticfield-mode antenna effectively functions.

12. The antenna for a portable radio device as in claim 10, wherein:

the magnetic-field-mode antenna is structured to generate a strong electric-field-mode component therein in addition to a magnetic-field-mode component; and the unbalanced current is intentionally supplied to the magnetic-field-mode antenna.

13. The antenna for a portable radio device as in claim 12, wherein:

a slot antenna is used as the magnetic-field-mode antenna; and a slot width of the slot antenna is made much wider than a slot length thereof to generate a strong electric-field-mode component in the slot antenna.

14. The antenna for a portable radio device as in claim 12, wherein:

a slot antenna is used as the magnetic-field-mode antenna; and a slot of the slot antenna is turned in its longitudinal direction to form a longer slot and to generate a stronger electric-field-mode component.

15. An antenna for a portable radio device, the antenna comprising:

a slot antenna having an elongate rectangular slot defined by a pair of long side patterns and a pair of short side patterns, wherein:

the pair of short side patterns are connected to each other through a matching capacitor.

16. The antenna for a portable radio device as in claim 15, wherein:

the portable radio device is a finger-ring-type device having a ring to be worn by a person; and the slot antenna is mounted on the ring.

17. The antenna for a portable radio device as in claim 16, wherein:

the portable radio device further includes a plate mounted on the ring;

a ground surface is formed on the plate; and the ground surface is connected to one point of the slot antenna to give a ground potential thereto, and a high frequency signals are fed to another point of the slot antenna.

18. An antenna for a portable radio device, the antenna having a slot antenna, the slot antenna comprising:

an elongate rectangular substrate having a pair of long sides and a pair of short sides;

an antenna pattern formed on the substrate to define an elongate slot formed along the long side of the substrate, the elongate slot being turned once or more times at the short side of the substrate forming at least one turning portion so that the antenna pattern is also turned while being spaced apart at an inner side thereof; and a matching capacitor connected between two portions of antenna pattern defining the turning portion to strengthen an electric-field-mode component of the slot antenna.

* * * * *